US005893776A

United States Patent [19]

Black et al.

[11] Patent Number: 5,893,776

[45] Date of Patent: Apr. 13, 1999

[54] ELECTRICAL CONNECTION STRIP WITH RELEASABLE MOUNTING FOR MOUNTING ON BRACKETS OF DIFFERENT CONFIGURATIONS

[75] Inventors: Andrew Black, South Wales, United Kingdom; Michael Fasano, Huntington; Michael Fasano, Jr., Smithtown, both of N.Y.

[73] Assignee: Porta Systems Corp., Syosset, N.Y.

[21] Appl. No.: 08/840,728

[22] Filed: Apr. 3, 1997

[51] Int. Cl.[6] ..... H01R 13/66

[52] U.S. Cl. ..... 439/532

[58] Field of Search ..... 439/716, 717, 439/532

[56] References Cited

U.S. PATENT DOCUMENTS

| | | | |
|---|---|---|---|
| 4,281,885 | 8/1981 | Forberg et al. . | |
| 4,741,711 | 5/1988 | Singer, Jr. | 439/620 |
| 5,090,922 | 2/1992 | Rymer et al. | 439/716 |
| 5,145,418 | 9/1992 | Moranski et al. | 439/716 |
| 5,160,273 | 11/1992 | Carney | 439/108 |
| 5,297,970 | 3/1994 | Carney | 439/108 |
| 5,328,380 | 7/1994 | Carney | 439/188 |
| 5,342,209 | 8/1994 | Carney et al. | 439/92 |
| 5,356,309 | 10/1994 | Carney et al. | 439/352 |
| 5,380,226 | 1/1995 | Anderson | 439/724 |
| 5,507,077 | 4/1996 | Kotajima | 24/669 |
| 5,531,414 | 7/1996 | Benedetto et al. | 248/201 |

OTHER PUBLICATIONS

Quante AG, or one of its subsidiaries, manufactures' literature concerning the Quante SID C connection strip and mounting bracket; Date of Publication: Before Mar. 1997; Place of Publication: Europe (exact location unknown).

BT Networks and Systems' drawing entitled "Modular Cross Connect Backmount"; Date of Publication: After Oct. 1996; Place of Publication; United Kingdom.

Porta Systems Corp.'s "Connection Strip Technical Manual"; Date of Publication: After Feb. 1995; Place of Publication: United States.

*Primary Examiner*—Khiem Nguyen
*Assistant Examiner*—Eugene G. Byrd
*Attorney, Agent, or Firm*—Hoffmann & Baron, LLP

[57] ABSTRACT

An electrical connection strip with a releasable mounting for attaching to mounting brackets of different configurations. The electrical connection strip includes an elongated block of electrically non-conductive material and a first mounting assembly. The mounting assembly comprises two longitudinal members that extend from an end of the block with a cross member running between them. Attached to the cross member is a vertical locking member which extends above and below the longitudinal members. The vertical locking member includes a locking formation located above the longitudinal members and a boss located below the longitudinal members. The locking formation and boss are configured to cooperatively engage a locking recess in a tabbed mounting bracket and tabless mounting bracket respectively. A rotational fixity member comprises a region of the longitudinal members formed with a first notch and a second notch with each notch configured to receive an edge of the tabless mounting bracket and an edge of the tabbed mounting bracket respectively. A preferred embodiment also includes a second mounting assembly which is located opposite the first mounting assembly and is a mirror image of it.

24 Claims, 15 Drawing Sheets

ELECTRICAL CONNECTION STRIP WITH RELEASABLE MOUNTING FOR MOUNTING ON BRACKETS OF DIFFERENT CONFIGURATIONS

BACKGROUND OF THE INVENTION

1. Field of the Invention

The present invention relates to connection strips used for high density wiring in telecommunication systems, and more particularly relates to a novel mounting assembly that allows a single connection strip to be securely mounted on a variety of mounting brackets that are commonly available in the industry while being easily releasable from the brackets.

2. Description of the Prior Art

Connection strips for high density wiring in telecommunication systems are well-known devices. One such device is described in U.S. Pat. No. 5,160,273 to Carney, issued Nov. 3, 1992, the disclosure of which is incorporated herein by reference.

A connection strip is generally configured to attach to a mounting bracket. In the telecommunications industry there are a variety of mounting bracket configurations that are presently being used because the connection strip manufacturers customarily design their connection strips to attach to their mounting brackets.

One such mounting bracket is described in U.S. Pat. No. 5,356,309 to Carney et al., issued Oct. 18, 1994 which discloses a tabbed mounting bracket, the disclosure of which is incorporated herein by reference. The tabbed mounting bracket disclosed in this patent includes an excluding protrusion as illustrated by item 44 in FIGS. 2 and 5 of the present application. A second mounting bracket is disclosed in U.S. Pat. No. 4,481,885 to Forberg et al. issued Aug. 4, 1981, the disclosure of which is incorporated herein by reference. This patent discloses a tabbed mounting bracket that does not include an excluding protrusion on the mounting tab. Another mounting bracket is manufactured by Quante AG, or one of its subsidiaries, (hereinafter "Quante") for the Quante SID C connection strip. The Quante mounting bracket is tabless and its pertinent structure is illustrated in FIG. 3 of the present application. A tabless mounting bracket similar to the Quante bracket is known as a "Modular Cross Connect Backmount" and is disclosed in drawings prepared by BT Network and Systems, a division of British Telecommunications plc.

The Carney et al. '309 patent also discloses a releasable mounting. Prior to this disclosure the removal of a connection strip generally required the use of various tools to remove the bracket. The releasable mounting disclosed therein is equipped with release tabs which when pulled back allow the connection strip to be removed from the mounting bracket. Since both tabs must be pulled to release the connection strip, the process of removing the block generally requires the use of two hands by a technician.

In view of the foregoing there is a need for a connection strip that is capable of being mounted on a variety of mounting brackets and is easily releasable by the use of a single hand.

OBJECTS AND SUMMARY OF THE INVENTION

It is an object of the present invention to provide a connection strip which is capable of being mounted on a variety of different mounting brackets.

It is another object of the present invention to provide a connection strip which is capable of being easily releasable from a variety of mounting brackets without the use of special tools for each mounting bracket.

It is yet another object of the present invention to provide a connection strip which is capable of making a ground connection to a variety of mounting brackets.

In accordance with one form of the present invention an electrical connection strip includes an elongated block of electrically non-conductive material and a mounting assembly. The mounting assembly includes two longitudinal members that extend from an end of the block with a cross member running between them. Attached to the cross member is a vertical locking member which extends above and below the longitudinal members. The vertical locking member includes a locking formation located above the longitudinal members on its outside surface and a boss located below the longitudinal members on its inside surface. The locking formation and boss are configured to cooperatively engage a locking recess in a tabbed mounting bracket and tabless mounting bracket respectively. A rotational fixity member preferably includes regions of the longitudinal members formed with a first notch and a second notch with each notch configured to receive an edge of the tabless mounting bracket and an edge of the tabbed mounting bracket respectively.

In a preferred embodiment there is also provided a second mounting assembly at the other end of the block. A tab plate member is preferably included which runs between the longitudinal members and is outside of the cross member, and support tabs are preferably secured to the bottom of the block at each end. Preferably, an extension is connected to the vertical locking member above the locking formation and the block is formed with a vertical-locking-member-receiving cavity which cooperatively receives the extension member when it is pushed in to remove the block from either a tabbed mounting bracket or a tabless mounting bracket. The preferred embodiment may be optionally equipped with an electrically conductive shim to provide an electrical connection between a ground strip within the block and a mounting bracket.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
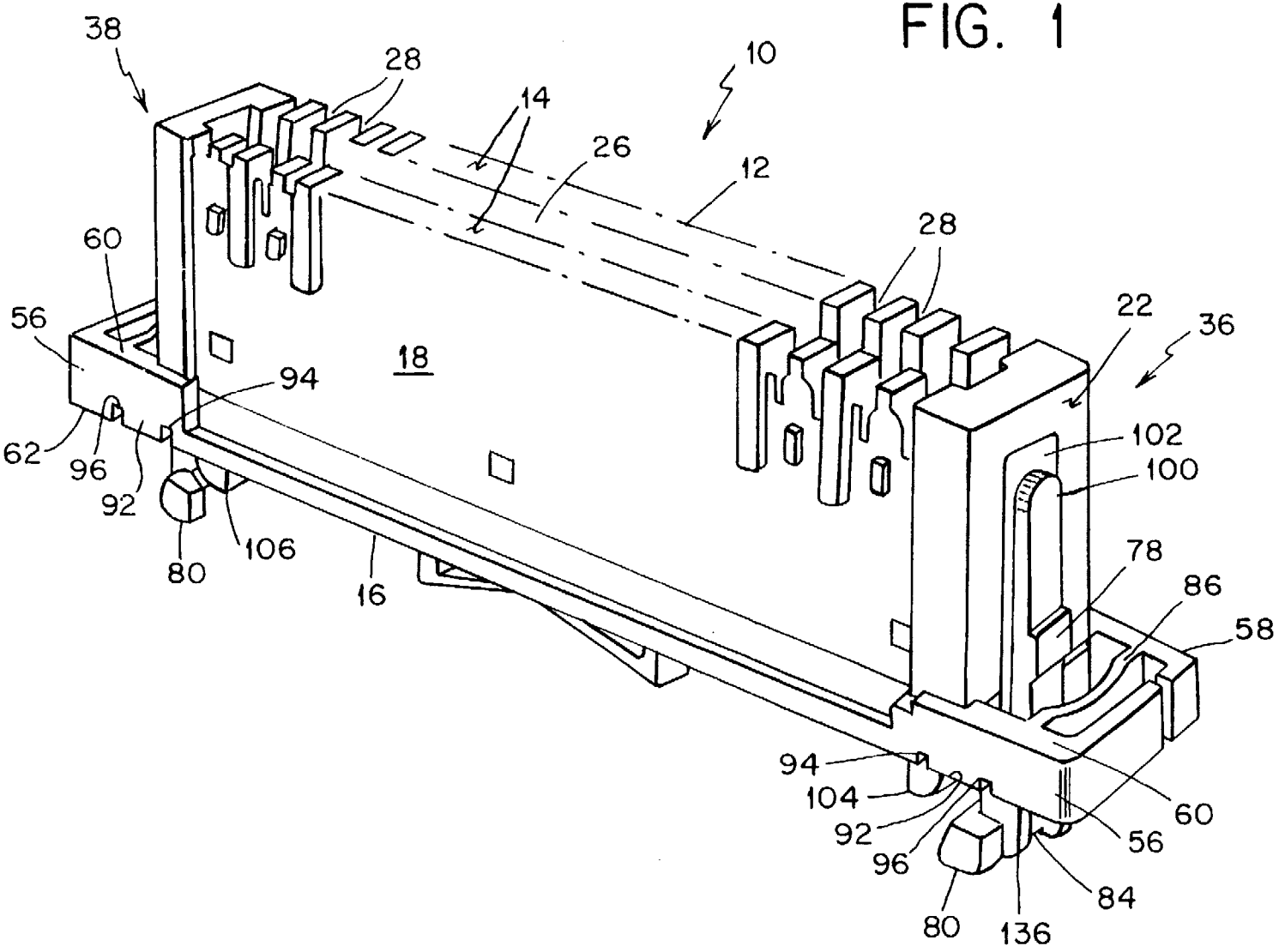
FIG. 1 is a perspective view showing a first embodiment of a connection strip according to the present invention.
Figure 4:
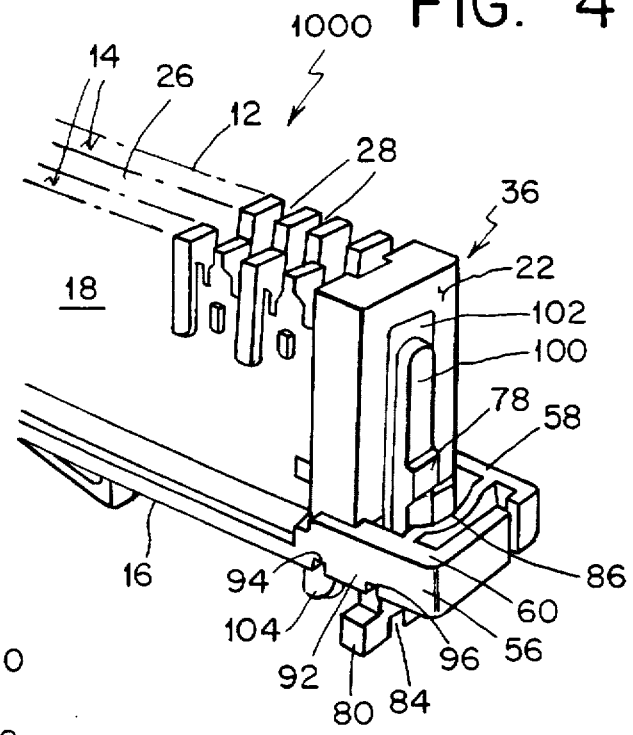
FIG. 4 is a fragmentary perspective view showing a second embodiment of a connection strip according to the present invention.
Figure 14:
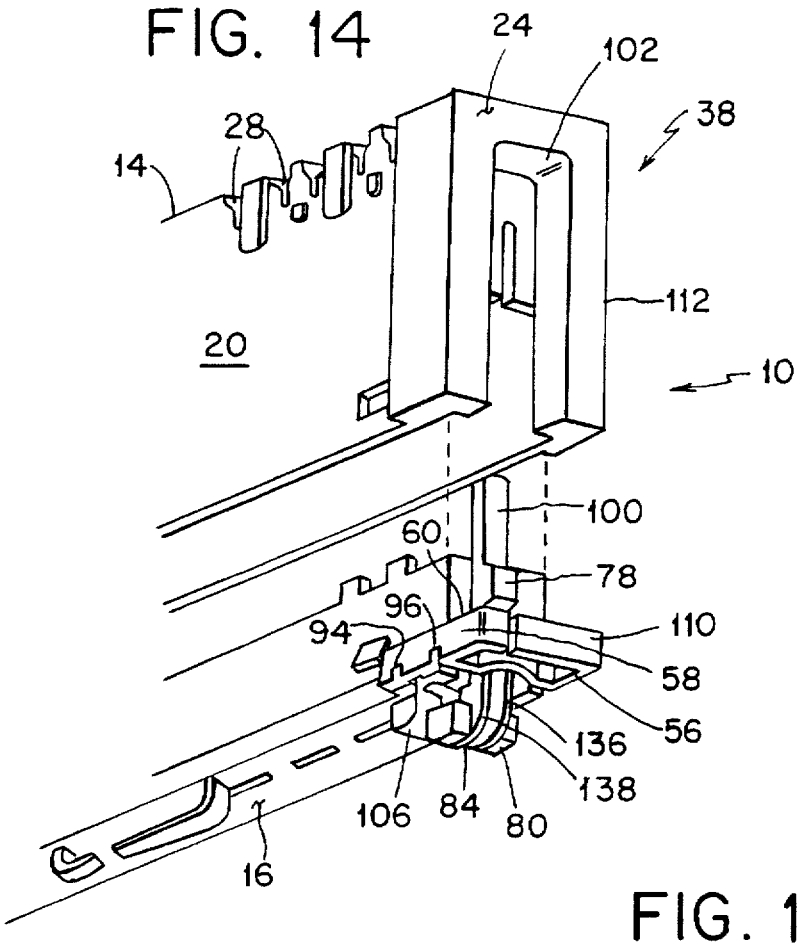
FIG. 14 is a fragmentary exploded perspective view showing one end of a base and a contact holder portion of the first embodiment of the connection strip.
Figure 17:
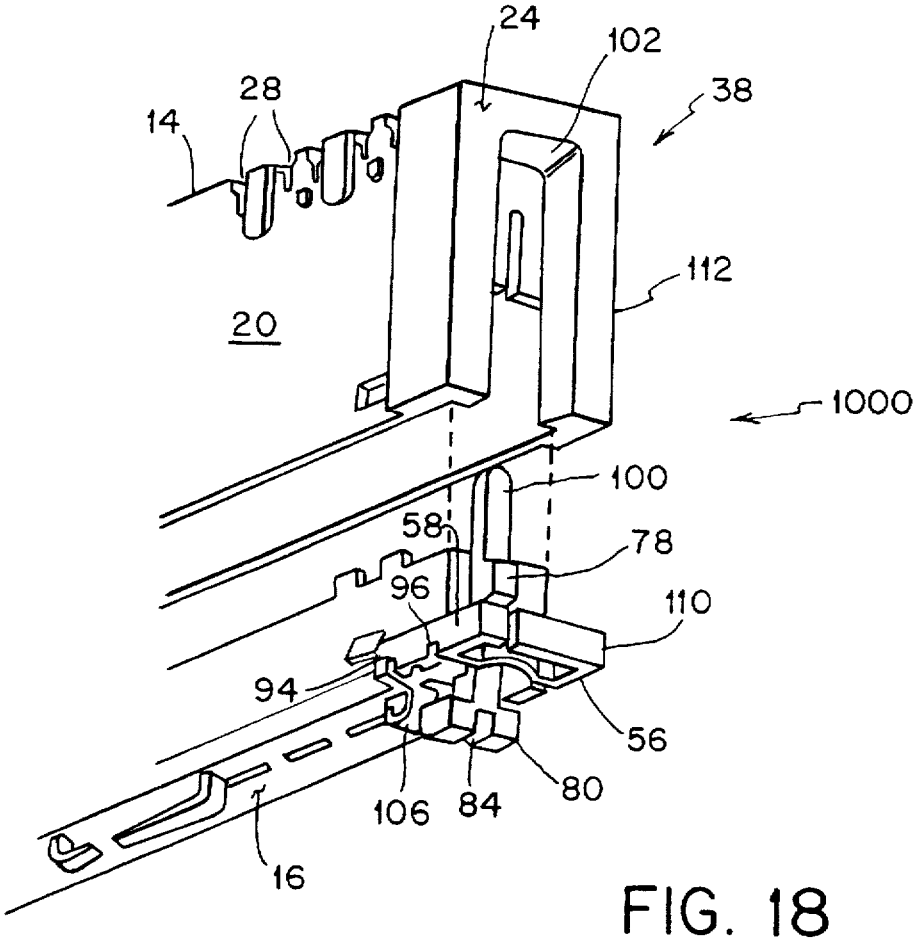
FIG. 17 is a fragmentary exploded perspective view showing one end of a base and a contact holder portion of the second embodiment of the connection strip.
Figure 18:
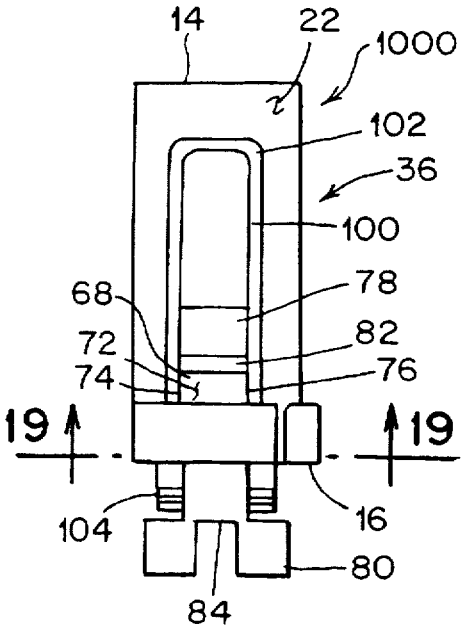
FIG. 18 is an end elevation view of the second embodiment of the connection strip.
Figure 19:
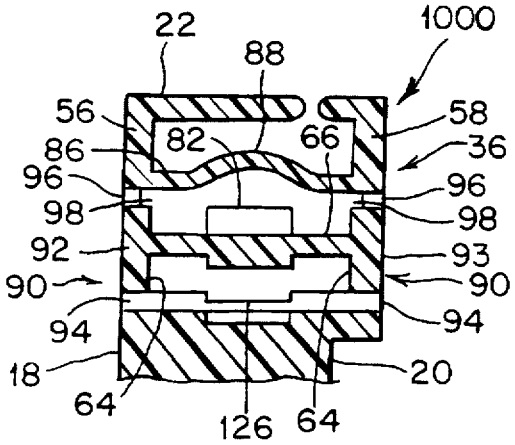
FIG. 19 is a fragmentary section view taken along line 19—19 of FIG. 18.

Referring to FIGS. 1 and 4, a first embodiment 10 and second embodiment 1000 of an electrical connection strip are respectively shown. Elements common to both embodiments have been designated with the same reference numerals. The connection strip preferably includes an elongated block 12 with a first mounting assembly 36 located at its first end 22. Preferably, the connection strip also includes a second mounting assembly 38 located at the second end 24 of the block 12. The block 12 and mounting assemblies 36 and 38 are preferably formed of an electrically non-conductive material such as a thermoplastic. Preferably, the connection strip 10, 1000 is made of a moldable resin having a high flexural modulus, such as a polycarbonate resin. One such suitable resin is sold by General Electric company under the trademark LEXAN and is more specifically classified as G.E. Lexan, 940. The block 12 includes a top 14, bottom 16, front face 18, back face 20 (see FIGS. 14 & 17), first end 22, and second end 24. Preferably, a first support tab 104 and a second support tab 106 are respectively attached to the bottom 16 of the block at the first and second ends 22 and 24. The block 12 may be formed along the top 14 with a central recess 26 and a plurality of transverse slots 28. The block is preferably hollow and contains internal electrical connector elements (not shown). These connector elements can be accessed by wires (also not shown) which are pressed down into the transverse slots 28. FIGS. 14 and 17 illustrate that the block is preferably an assembly of two parts, namely, a base portion 110 and a contact holder 112. The internal construction of a connection strip of this type is given in U.S. Pat. No. 5,160,273 the disclosure of which has been previously incorporated herein by reference.

Figure 2:
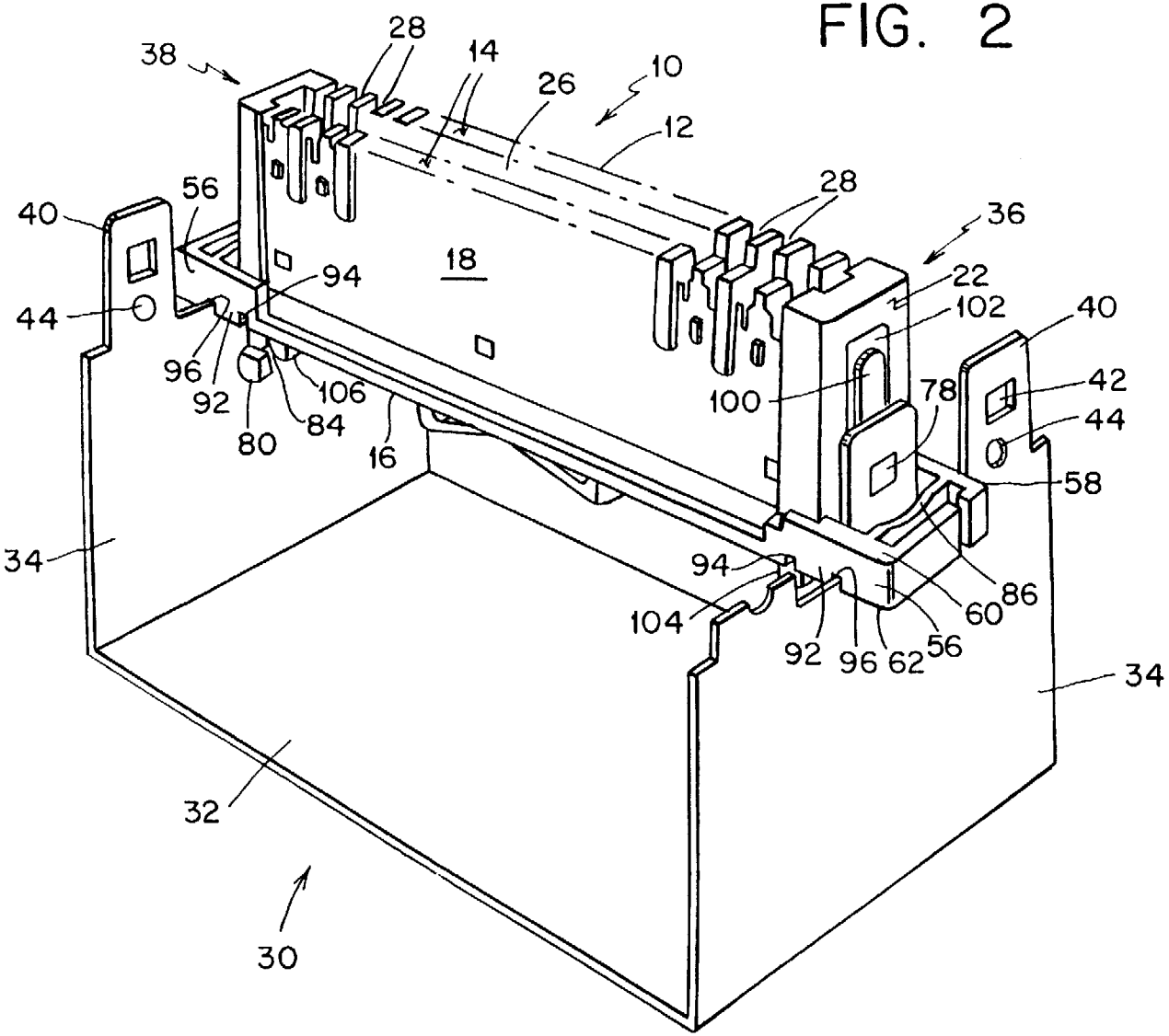
FIG. 2 is a perspective view similar to FIG. 1, but showing the connection strip mounted on a tabbed mounting bracket.
Figure 5:
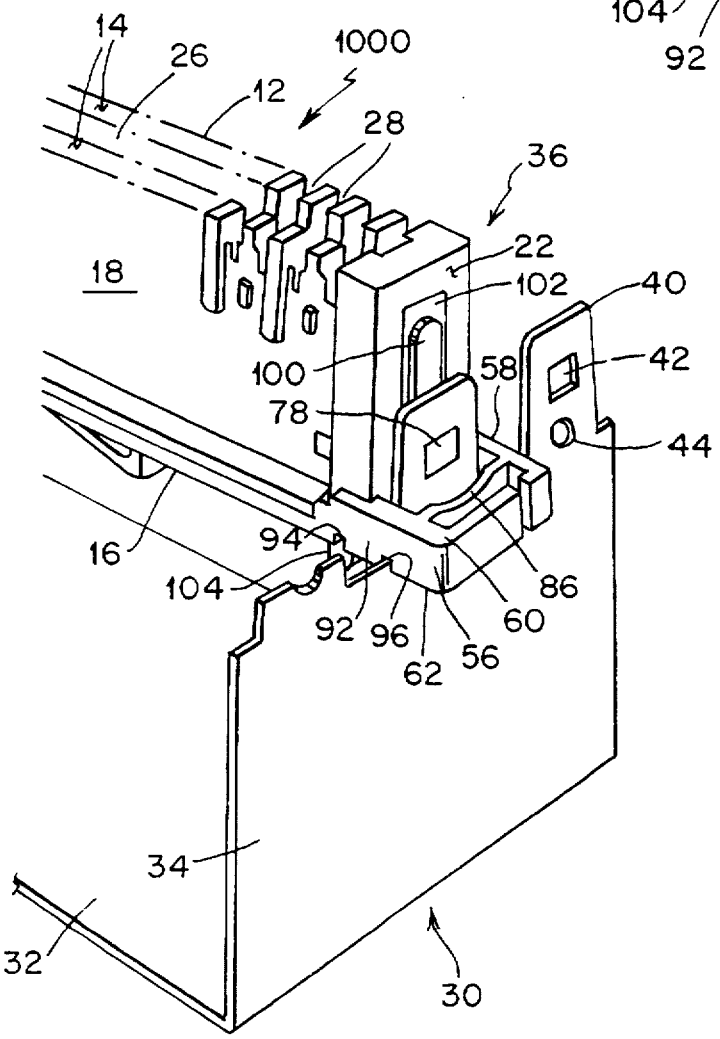
FIG. 5 is a perspective view similar to FIG. 4, but showing the connection strip mounted on a tabbed mounting bracket.

FIGS. 2 and 5, respectively show the first and second embodiments 10 and 1000 of the invention attached to a tabbed mounting bracket 30. Although the tabbed mounting bracket 30 is not part of this invention, a brief description is provided to better understand the embodiments 10 and 1000. The tabbed mounting bracket 30 is generally formed of an electrically conductive material and is trough shaped with a bottom wall 32 and a pair of side walls 34. The side walls 34 are spaced apart by a distance to accommodate the first and second mounting assemblies 36 and 38 on the block 12. A plurality of spaced apart mounting tabs 40 extend up from the upper edges of the side walls 34. The mounting tabs 40 each contain a locking recess 42 which is used to lock the connection strip 10, 1000 in place when mounted thereon. FIGS. 2 and 5 also depict a tabbed mounting bracket 30 that includes an excluding protrusion 44 on the mounting tabs. A more detailed description of a tabbed mounting bracket of this type is given in U.S. Pat. No. 5,356,309 the disclosure of which has been previously incorporated herein by reference. In view of the foregoing, it will be apparent that the first and second embodiments 10 and 1000 are able to attach on tabbed mounting brackets that do not include excluding protrusions 44 as disclosed in U.S. Pat. No. 4,481,885 the disclosure of which has been previously incorporated herein by reference. The term tabbed mounting bracket 30 as used hereinafter is intended to include all of the aforementioned embodiments as well as any similar structure.

Figure 3:
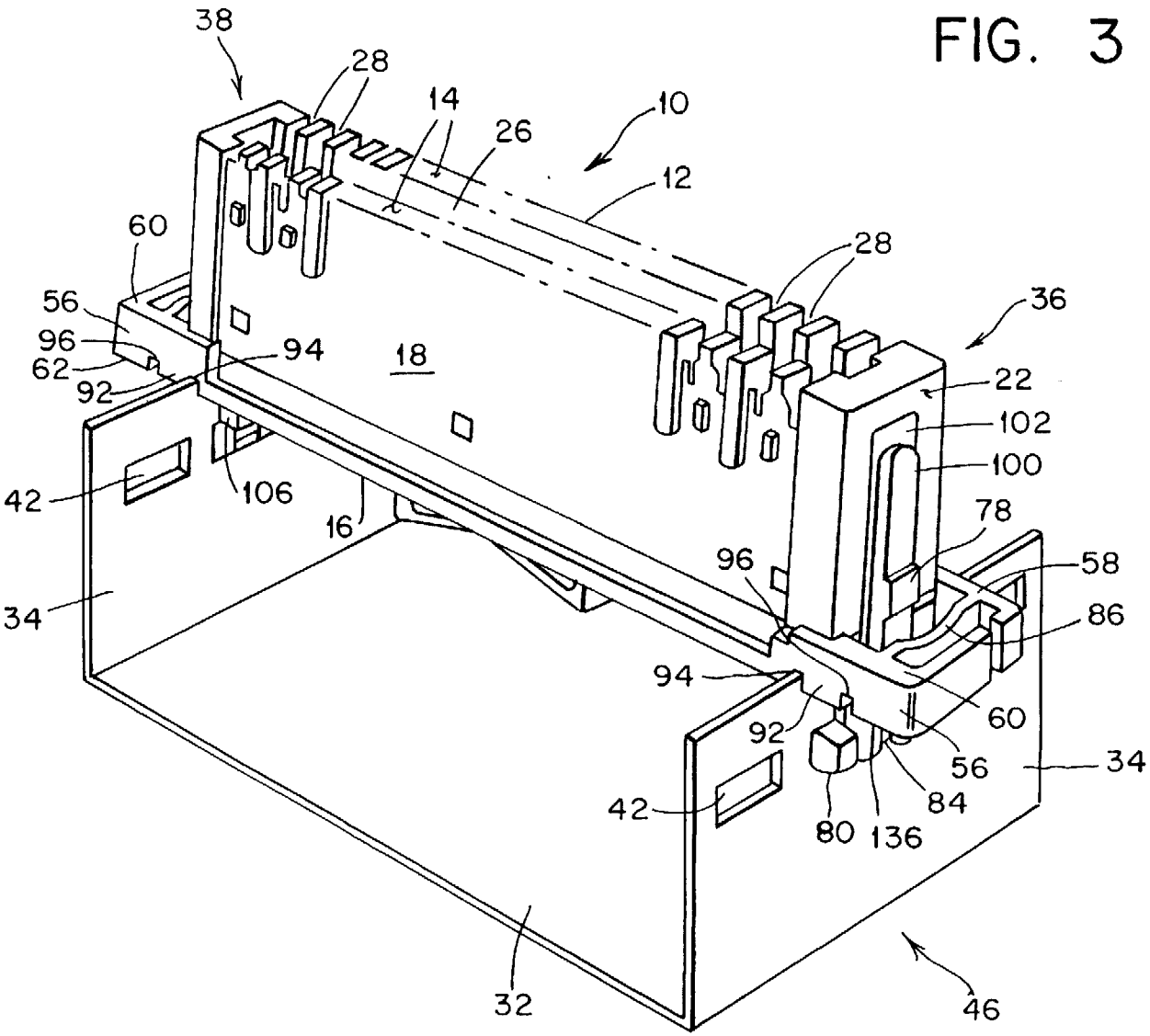
FIG. 3 is a perspective view similar to FIG. 1, but showing the connection strip mounted on a tabless mounting bracket.
Figure 6:
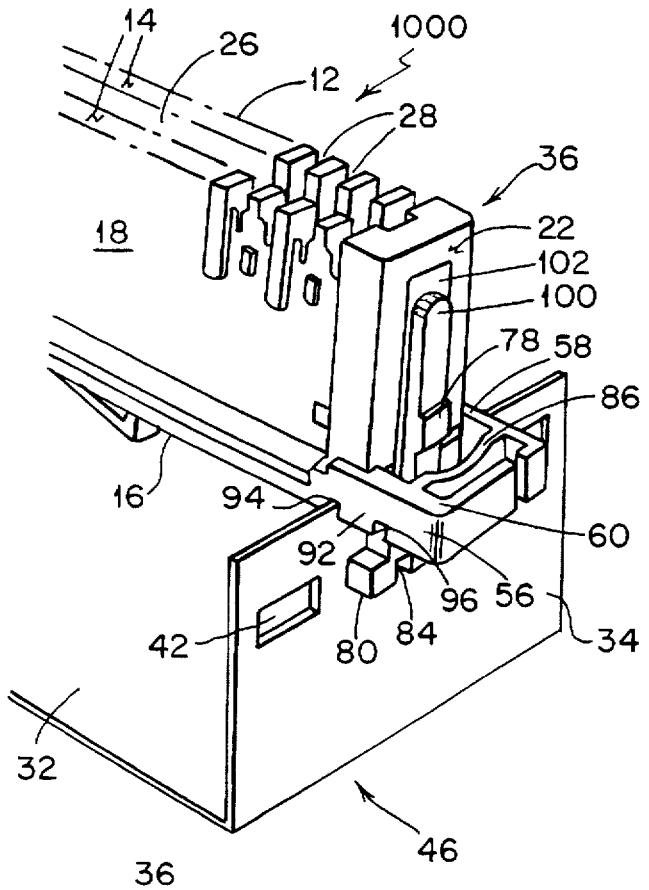
FIG. 6 is a perspective view similar to FIG. 4, but showing the connection strip mounted on a tabless mounting bracket.

FIGS. 3 and 6 respectively show the first and second embodiments of the invention attached to a tabless mounting bracket 46. The tabless mounting bracket 46 is similar to the tabbed mounting bracket 30 as it includes the same basic components, a bottom wall 32 and pair of side walls 34, except for the attributes associated with the mounting tabs 40. The tabless mounting bracket 30 includes a plurality of spaced apart locking recesses 42 along the upper edge of the side walls 34. A tabless mounting bracket 46 similar to the one described is known in the art and is manufactured by Quante for their SID C connection strip. The term tabless mounting bracket 46 as used hereinafter is intended to include all of the aforementioned embodiments as well as any similar structure.

Figure 7:
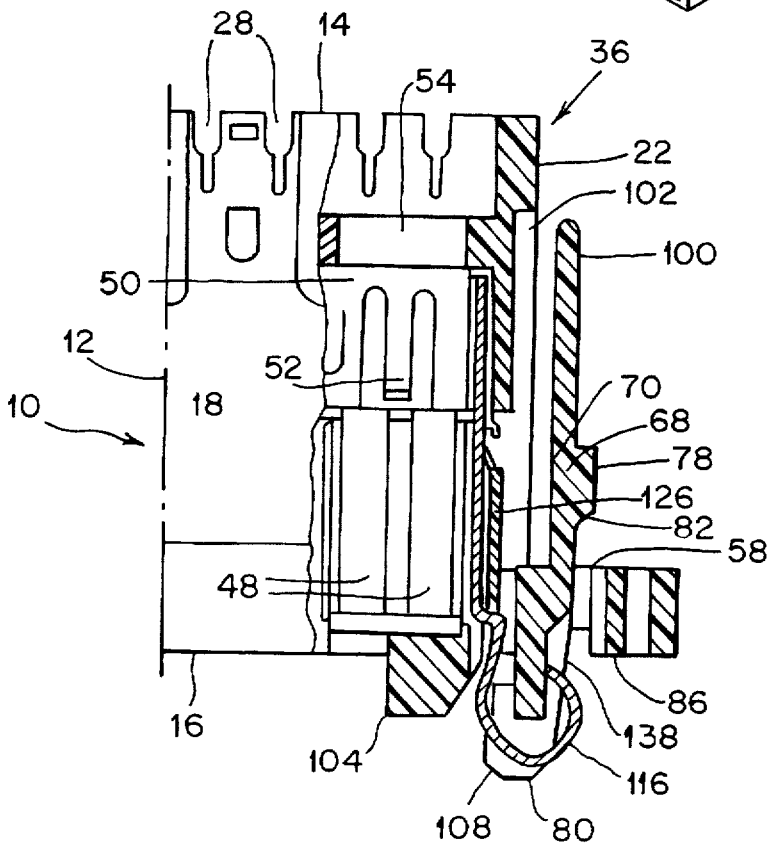
FIG. 7 is a fragmentary side elevational view, partially cut away and partially in section, of the first embodiment of the connection strip.
Figure 10:
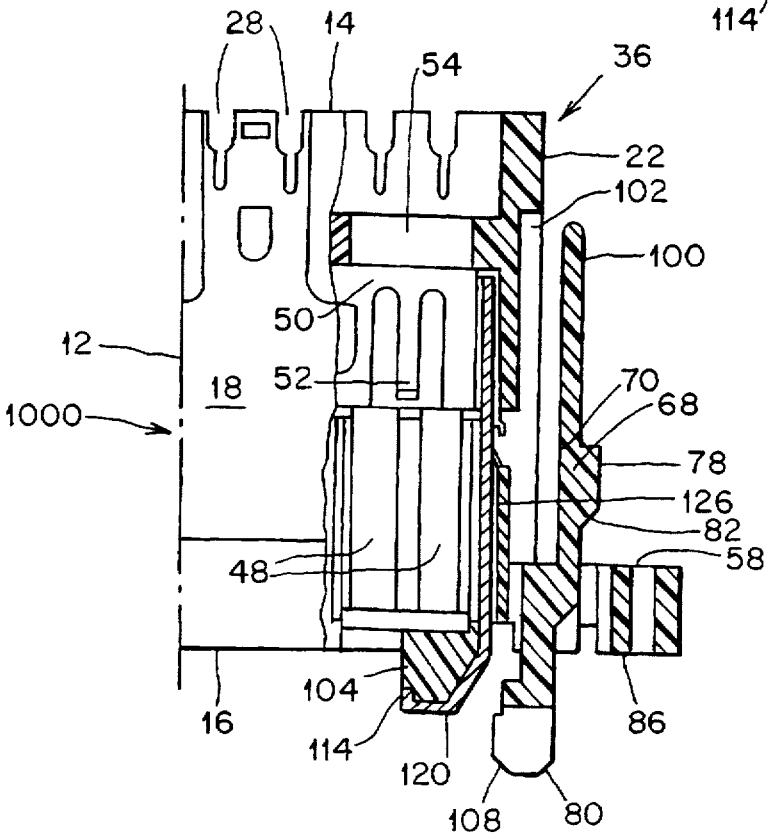
FIG. 10 is a fragmentary side elevational view, partially cut away and partially in section, of the second embodiment of the connection strip with an electrically conductive shim suitable for use on a tabless mounting bracket.

The internal configuration within the block 12 of the first embodiment and the second embodiment are the same. FIGS. 7 and 10 illustrate that the block 12 is normally provided with spring finger signal contacts 48 mounted therein. An electrically conductive ground strip 50 is also preferably mounted within the block 12. This ground strip includes spring finger ground contacts 52. The block 12 is provided with a plurality of apertures 54 within the central recess 26 into which a card-like insert may be inserted to separate the spring finger signal contacts 48 and spring finger ground contacts 52 of each respective aperture 54.

In the first and second embodiments 10 and 1000 of the invention the block 12 has a first mounting assembly 36 attached to the first end 22 of the block 12 and preferably a second mounting assembly 38 attached to the second end 24 of the block 12. Since the second mounting assembly 38 is a mirror image of the first mounting assembly 36, only the first mounting assembly 36 will be described in detail. Note, however, that the second mounting assembly is shown in FIGS. 14 & 17. The mounting assemblies and other attributes for the first embodiment 10 and second embodiment 1000 are similar in structure, but have certain differences. The structure which is common to both embodiments 10 and 1000 is described initially while the differences are described separately hereinafter.

Referring to FIGS. 7, 14, 15, and 16 concerning the first embodiment and FIGS. 10, 11, 17, 18 and 19 concerning the second embodiment 1000, the first mounting assembly comprises a first longitudinal member 56 and a second longitudinal member 58, which extend from the first end 22 and are adjacent to the bottom 16 of the block 12. The first and second longitudinal members 56 and 58 are respectively located at the front and back faces 18 and 20 of the block 12, and both have a top 60, a bottom 62, and an inner face 64. The longitudinal members 56 and 58 are preferably formed with a groove 98 on their inner faces 64 which is configured to receive an edge of a mounting tab 40 when attached to a tabbed mounting bracket 30. The groove 98 provides additional support to restrict both rotation and longitudinal translation. A cross member 66 extends between the inner faces 64 of the first and second longitudinal members 56 and 58. This cross member is elastically rotatable and bendable for reasons which will be described below.

Figure 8:
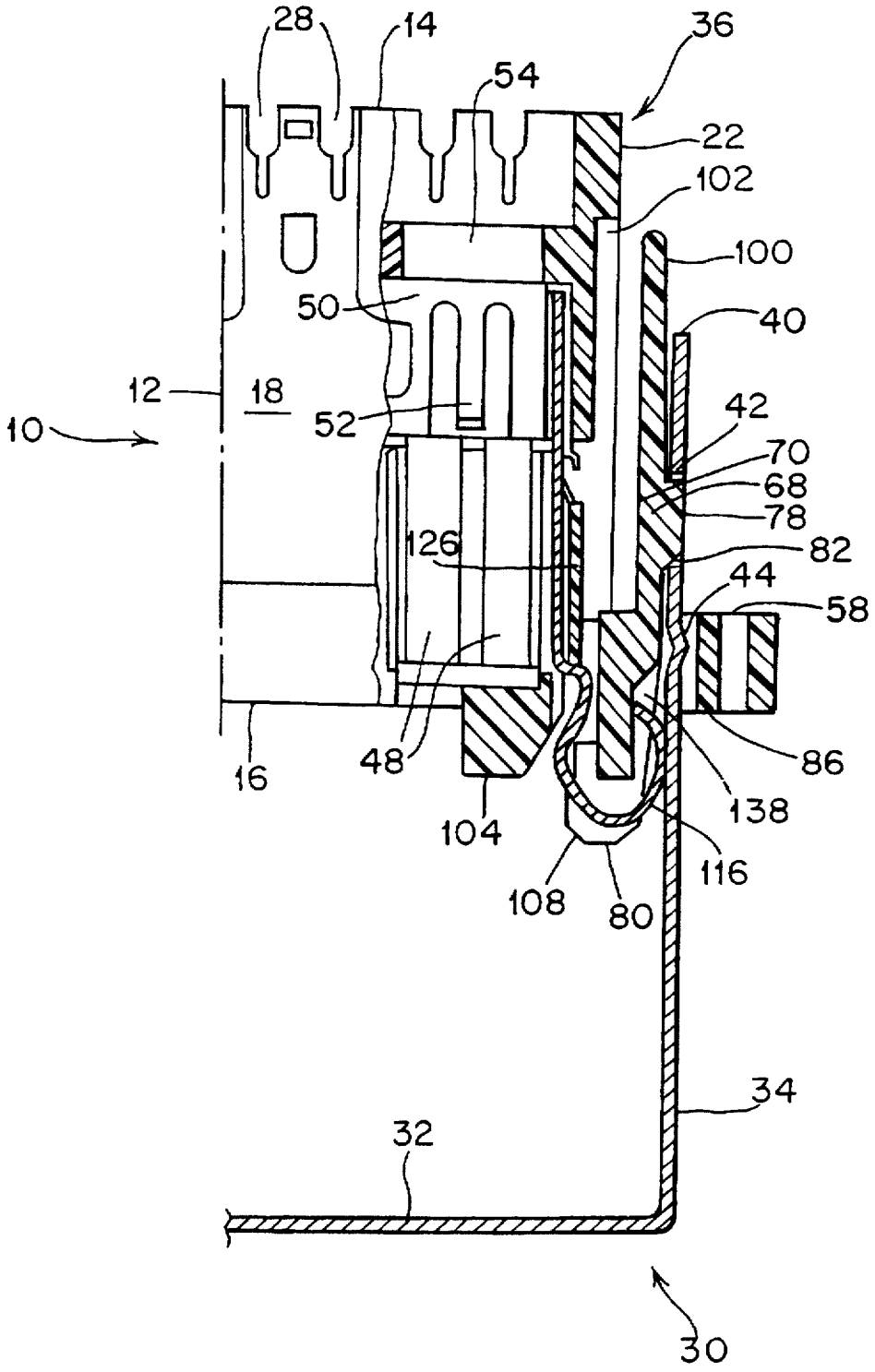
FIG. 8 is a view similar to FIG. 7, but showing the connection strip and mounting bracket in their relative positions as in FIG. 2.
Figure 9:
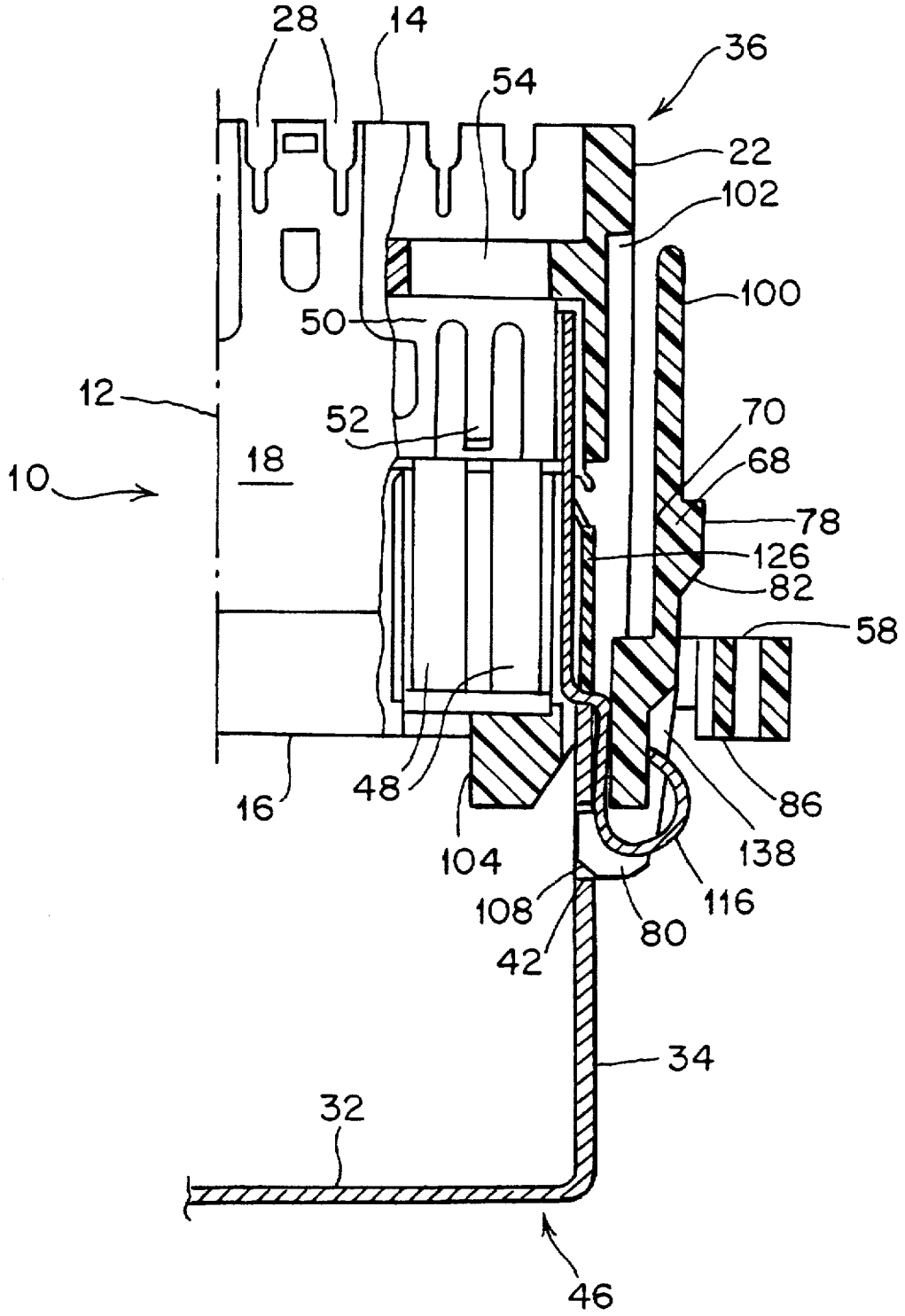
FIG. 9 is a view similar to FIG. 7, but showing the connection strip and mounting bracket in their relative positions as in FIG. 3.
Figure 12:
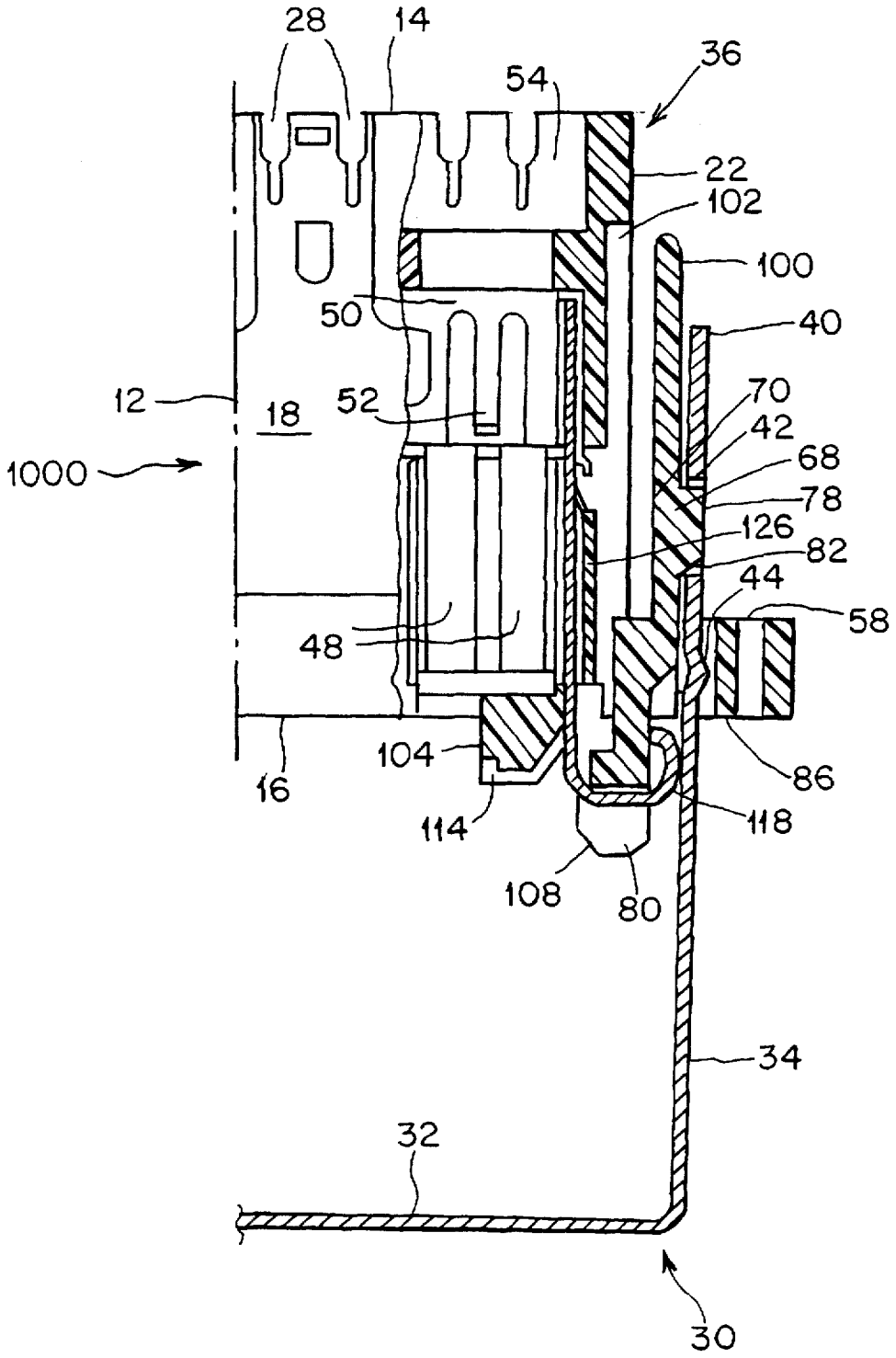
FIG. 12 is a view similar to FIG. 11, but showing the connection strip and mounting bracket in their relative positions as in FIG. 5.
Figure 13:
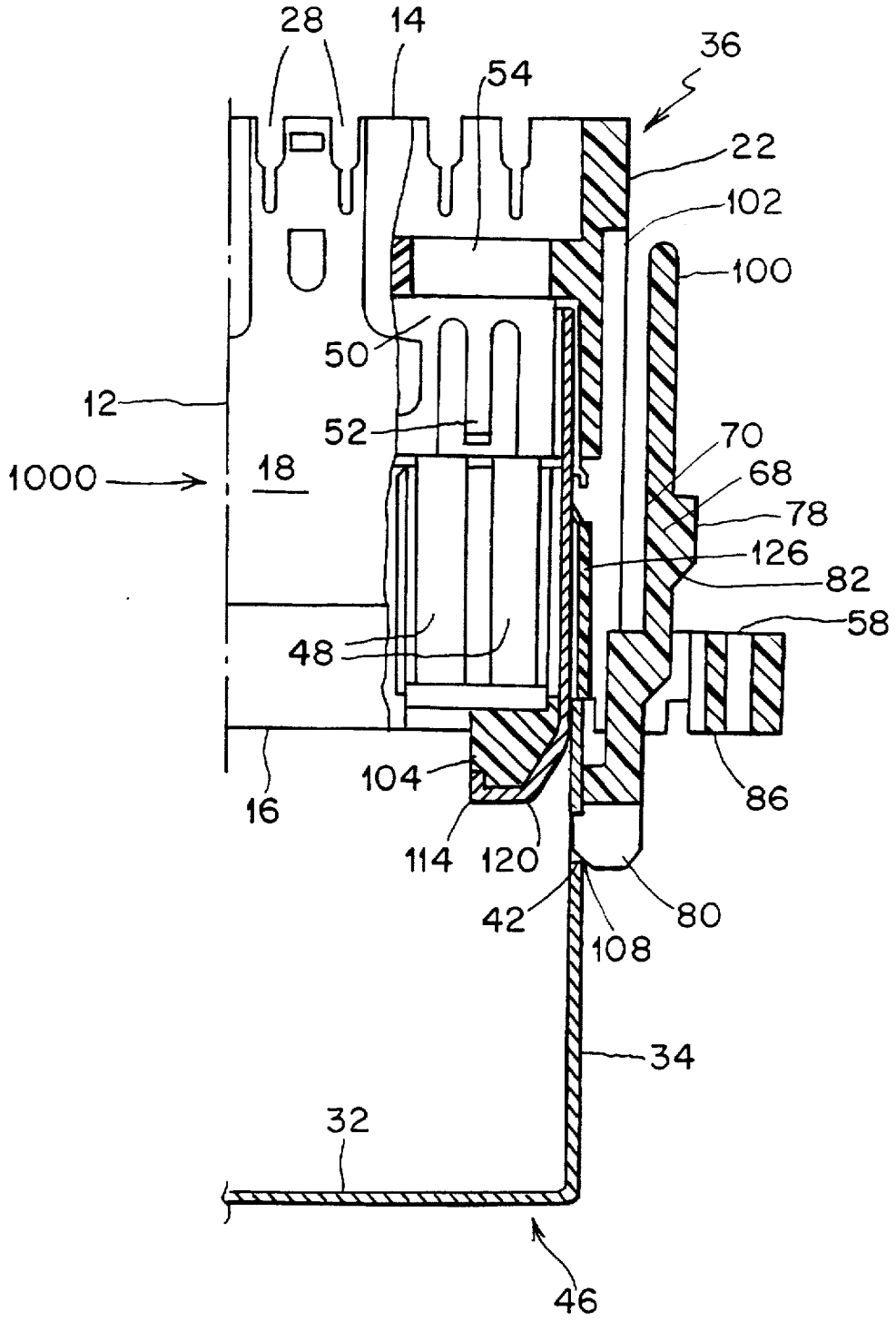
FIG. 13 is a view similar to FIG. 10, but showing the connection strip and mounting bracket in their relative positions as in FIG. 6.

A vertical locking member 68 is secured to the cross member 66 and extends above and below the first and second longitudinal members 56 and 58. The vertical locking member 68 has an inside surface 70 facing the block 12, an outside surface 72 facing away from the block 12, a first edge 74 and a second edge 76. The vertical locking member 68 is firm yet is resiliently bendable for reasons which will be described below. A locking formation 78 is attached to the outside surface 72 of the vertical locking member 68 above the longitudinal members 56 and 58. This locking formation 78 is slightly less than 1/16 of an inch in thickness and is configured to cooperatively engage a locking recess 42 in a tabbed mounting bracket 30 as shown in FIGS. 8 and 12. The locking formation 78 is preferably formed along its lower edge with a bevel 82. A boss is attached to the inside surface 70 of the vertical locking member 68 below the longitudinal members 56 and 58. This boss 80 is preferably formed with a shim recess 84 in its center and a chamfer 108 along its lower edge that faces toward the block. The boss 80 is configured to cooperatively engage a locking recess 42 in a tabless mounting bracket 46 as shown in FIGS. 9 and 13. Preferably, a tab plate member 86 formed with a curved central portion 88 extends between the inner faces 64 of the longitudinal members 56 and 58 and is located outside of the cross member 66. The tab plate member 86 provides additional support to restrict both rotation and longitudinal translation. The first mounting assembly also includes a rotational fixity member 90 to support the connection strip 10, 1000 from rotating. Preferably, the rotational fixity member 90 includes first and second regions 92 and 93 of the first and second longitudinal members 56 and 58 respectively where the regions 92, 93 are each formed with a first notch 94 and a second notch 96 with each notch configured to respectively receive an edge of the tabless mounting bracket 46 as shown in FIG. 3 and an edge of the tabbed mounting bracket 30 as shown in FIG. 2. The first notch 94 is located on the bottom 62 of the first and second longitudinal members 56 and 58 between the first end 22 of the block 12 and the cross member 66. The second notch 96 is located on the bottom 62 of the first and second longitudinal members 56 and 58 outside of the cross member 66 in a vertical plane adjacent to the outside surface 72 of the vertical locking member 68. When the connection strip 10, 1000 is provided with a second mounting assembly 38, the rotational fixity member 90 is not required because the combination of both mounting assemblies together restrains the connection strip 10, 1000 from rotating. However, the rotational fixity member is still preferred even when the second mounting assembly is employed.

Figure 20:
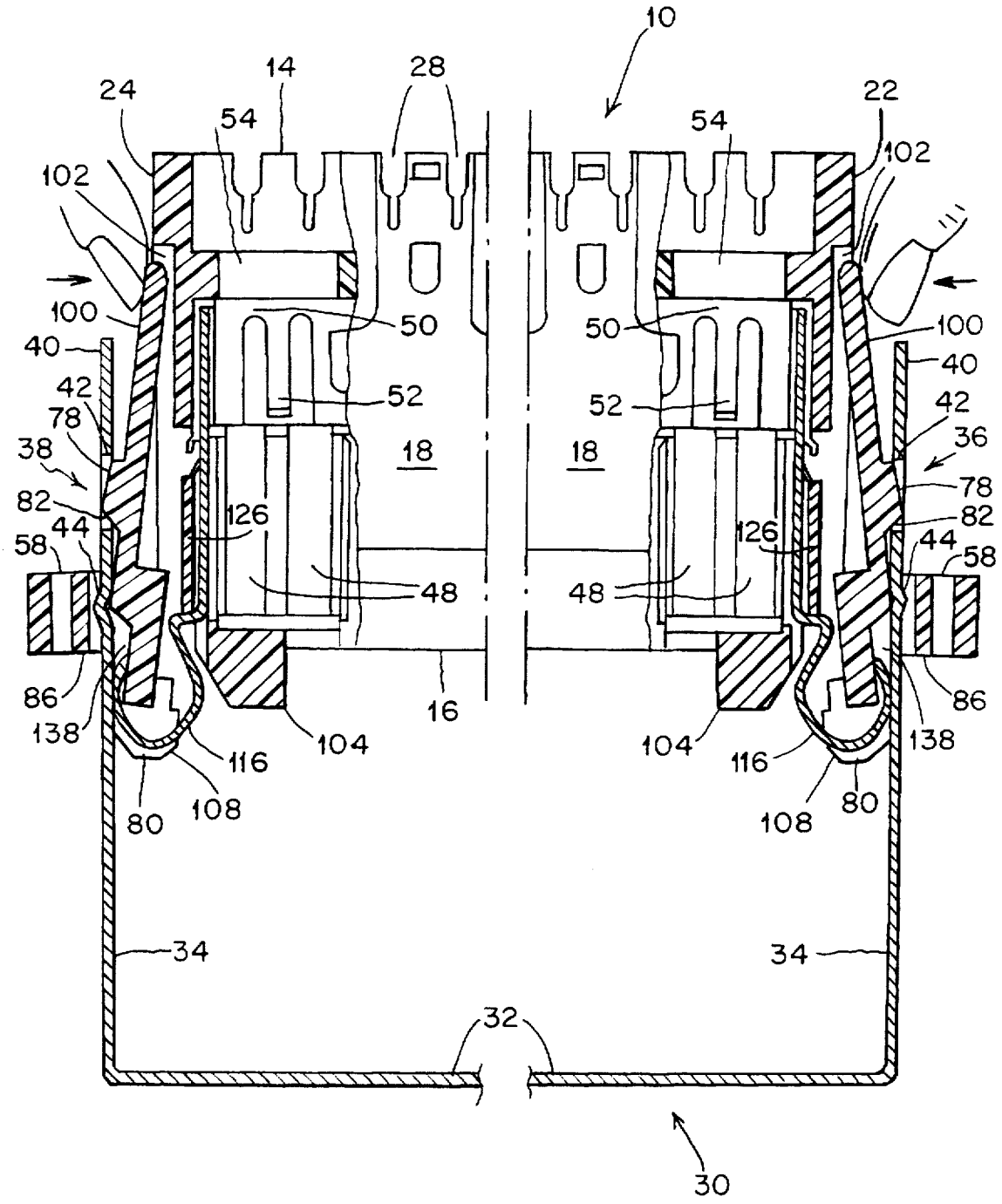
FIG. 20 is a view similar to FIG. 8, but showing the vertical locking member being depressed to release the connection strip.
Figure 21:
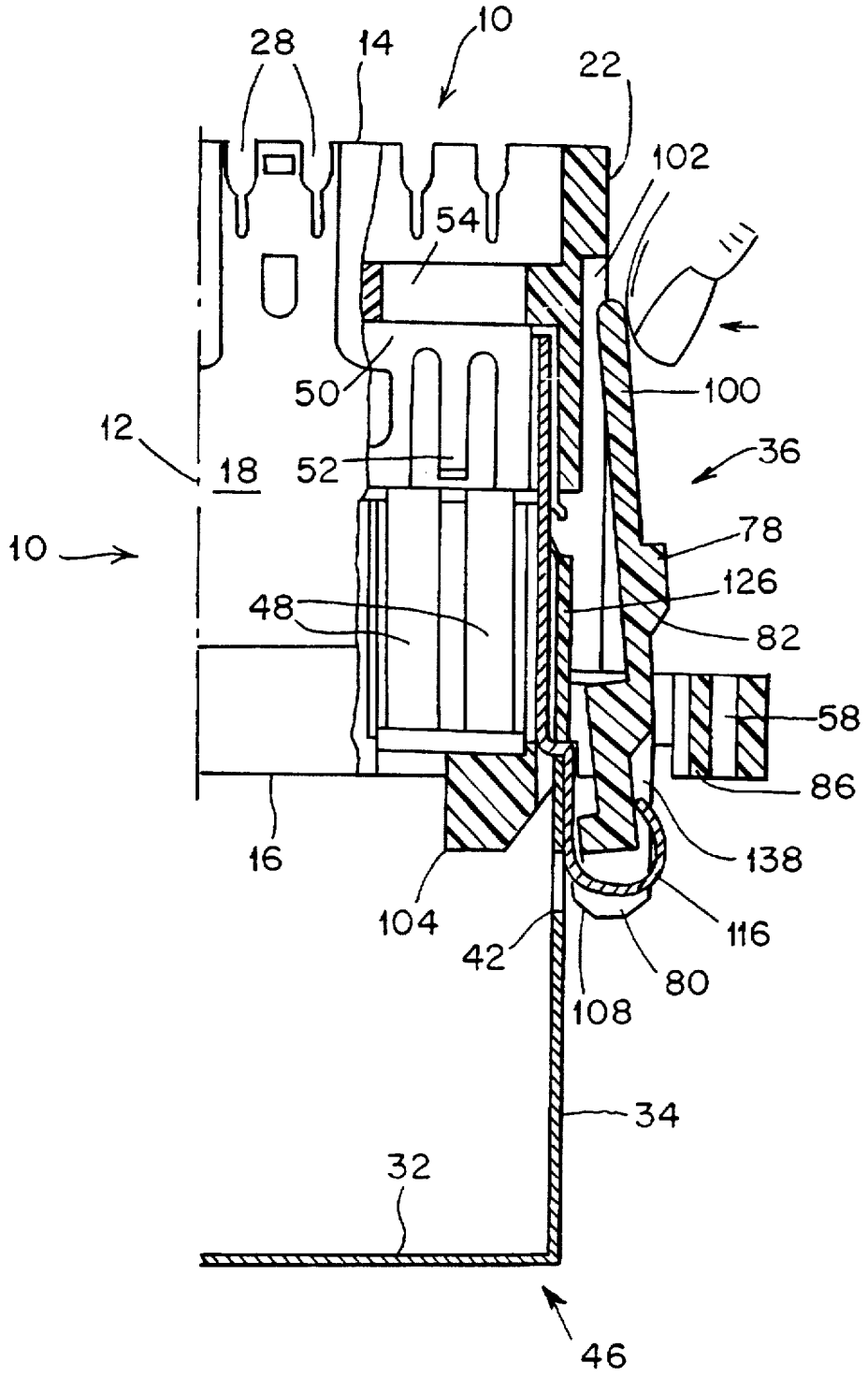
FIG. 21 is a view similar to FIG. 9, but showing the vertical locking member being depressed to release the connection strip.
Figure 25:
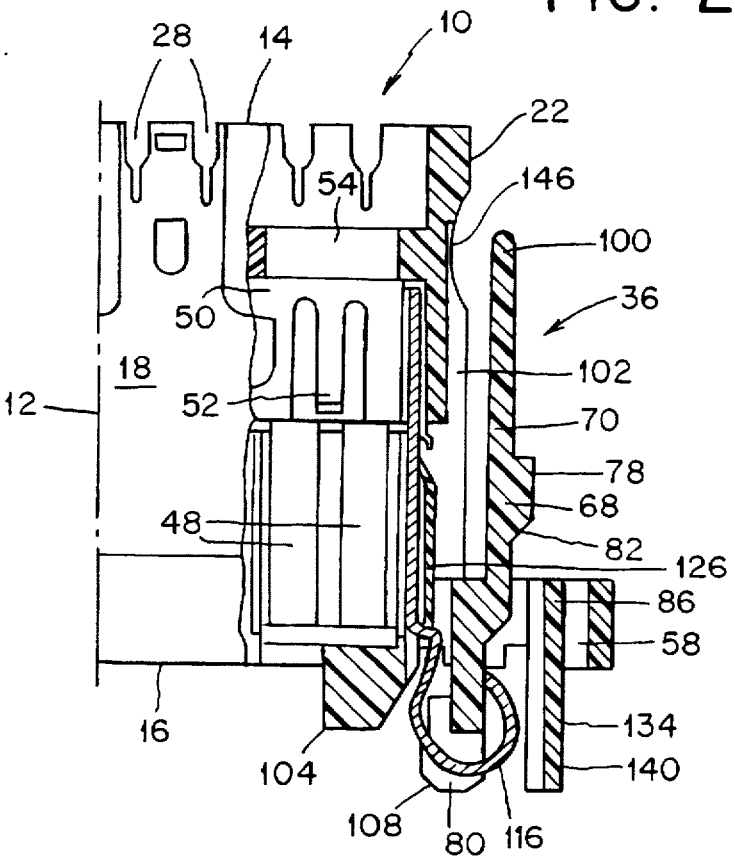
FIG. 25 is a view similar to FIG. 7, but showing a finger-grabbing recess and an alternative embodiment for a shim protector shield.

Preferably, the first mounting assembly 36 further includes an extension 100 connected to the vertical locking member 68 above the locking formation 78, and the block 12 is formed with a vertical-locking-member-receiving cavity 102 which cooperatively receives the extension member when it is pushed in to remove the connection strip 10, 1000 from either a tabbed mounting bracket 30 as shown in FIG. 20 or a tabless mounting bracket 46 as shown in FIG. 21. The depth of the vertical-locking-member-receiving cavity 102 is limited to prevent the vertical locking member 68 from being pushed in too far. Preferably, the block is further formed with a finger-grabbing recess 146 as shown in FIG. 25. The finger-grabbing recess 146 is advantageous because it makes it easier to grip the block 12 and to fully depress the vertical locking member 68 during installation and removal.

The attachment of the connection strip 10, 1000 to a tabbed mounting bracket 30 is illustrated in FIGS. 8 and 12. During mounting, the grooves 98 on the inner faces 64 of the longitudinal members 56 and 58 guide the connection strip 10, 1000 until the top edge of the mounting tab 40 engages the bevel 82 on the locking formation 78 causing the vertical locking member 68 to bend and the cross member 66 to twist which moves the locking formation 78 in toward the ends 22 and 24 of the block 12 thereby allowing the connection strip 10, 1000 to translate down to be seated in its second notch 96 as shown in FIG. 2. The connection strip 10, 1000 clears the excluding protrusion 44 on the mounting tab 40 because the tab plate member 86 has a curved central portion 88. Once the connection strip 10, 1000 is seated, the locking formation 78 snaps into the locking recess 42 located in the mounting tab 40 securing the connection strip 10, 1000 to the tabbed mounting bracket 30. It will be appreciated that the tab plate member 86 advantageously stiffens the overall connection and that the connection strip 10, 1000 can be attached to tabbed mounting brackets 30 that do not have excluding protrusions (not shown). The connection strip 10, 1000 is easily removed by applying pressure to the extension 100 on the vertical locking member 68 as shown in FIG. 20. The pressure on the vertical locking member 68 causes it to bend and the cross member 66 to twist which disengages the locking formation 78 from the locking recess 42.

The attachment of the connection strip 10, 1000 to a tabless mounting bracket 46 is illustrated in FIGS. 9 and 13. During mounting the edge of the tabless mounting bracket 46 engages the chamfer 108 on the boss 80 causing the vertical locking member 68 to bend and the cross member 66 to twist which moves the locking formation 78 out away from the ends 22 and 24 of the block 12 thereby allowing the connection strip 10, 1000 to translate down to be seated in its first notch 94 as shown in FIG. 3. Once the connection strip 10, 1000 is seated, the boss snaps into the locking recess 42 located along the upper edge of the side walls 34 securing the connection strip 10, 1000 to the tabless mounting bracket 46. The first and second support tabs 104 and 106 advantageously stiffen the connection by bracing the top of the bracket. Again, the connection strip 10, 1000 is easily removed by applying pressure to the extension 100 on the vertical locking member 68 as shown in FIG. 21. The pressure on the vertical locking member 68 causes the cross member 66 to twist which disengages the boss 80 from the locking recess 42.

Figure 11:
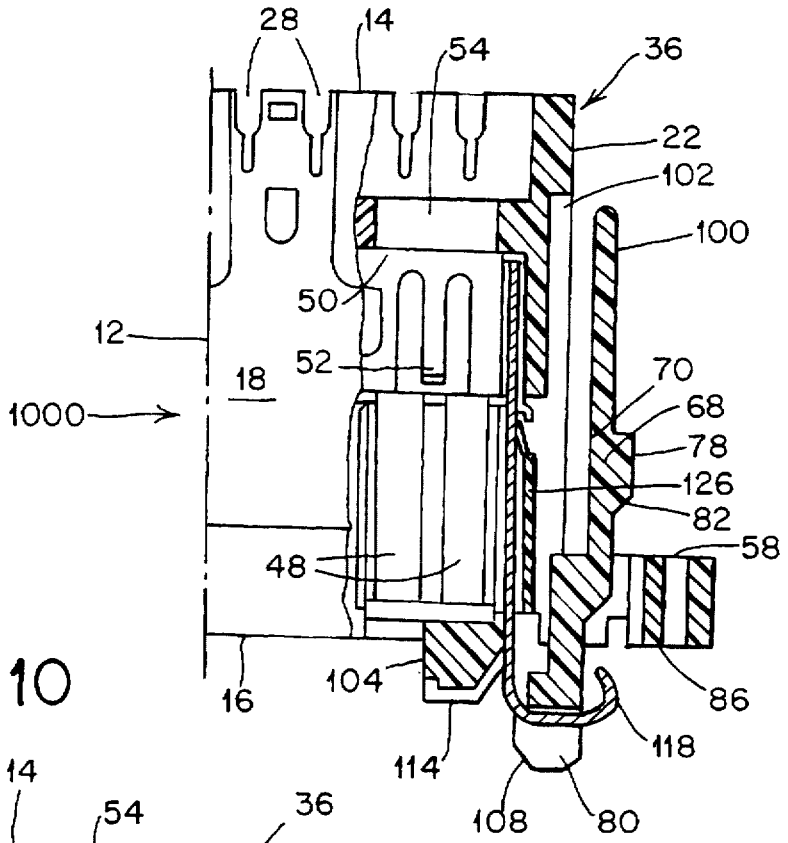
FIG. 11 is a fragmentary side elevational view, partially cut away and partially in section, of the second embodiment of a connection strip with an electrically conductive shim suitable for use on a tabbed mounting bracket.

Under certain circumstances, it is desired to provide an electrical connection between the ground strip 50 within the block 12 and a mounting bracket. Both the first embodiment 10 and the second embodiment 1000 are capable of making this connection to both the tabbed mounting bracket 30 or the tabless mounting bracket 46. The first embodiment 10 uses a curled shim 116 shown in FIG. 22 to make the electrical connection on both a tabbed and tabless mounting bracket 30 and 46. The second embodiment uses a long shim 118 shown in FIG. 23 and a short shim 120 shown in FIG. 24 to make the electrical connection respectively on a tabbed mounting bracket 30 and a tabless mounting bracket 46. All of the shims 116, 118 and 120 are electrically conductive and each is formed with upper and lower tabs 122 and 124 on their back leg 128. The upper tab 122 is configured to press against the ground strip to ensure good electrical contact. The lower tab is configured to engage an edge of a shim retaining wall 126 within the block 12 as shown in FIGS. 7, 10, and 11. The electrically conductive shims 116, 118 and 120 may be made out of sheet brass, spring tempered copper alloy or some other resilient electrically conductive material. The details concerning the electrically conductive shims for the first embodiment 10 and second embodiment 1000 are different. These details will now be described in turn with further reference to the appropriate drawings.

Figure 15:
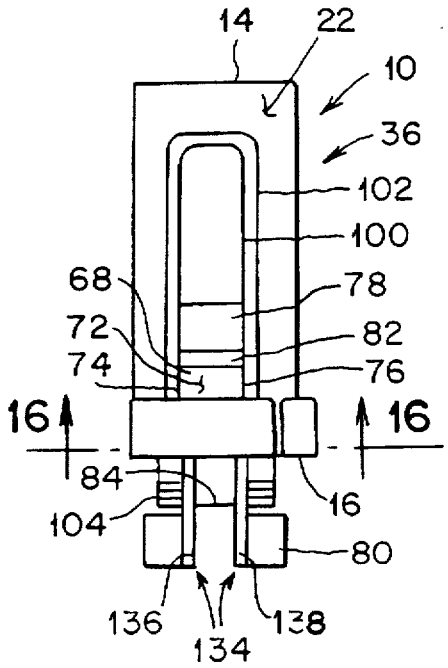
FIG. 15 is an end elevation view of the first embodiment of the connection strip.
Figure 16:
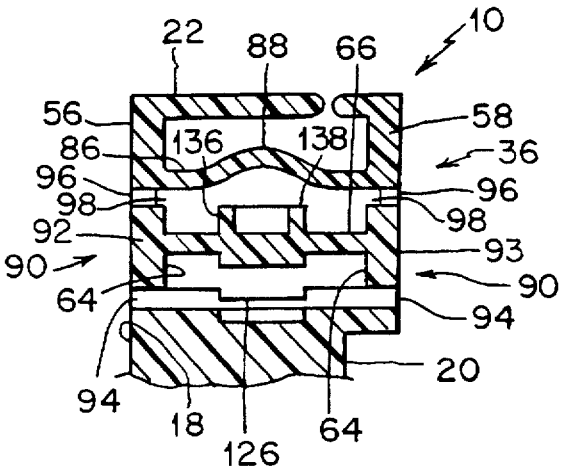
FIG. 16 is a fragmentary section view taken along line 16—16 of FIG. 15.
Figure 22:
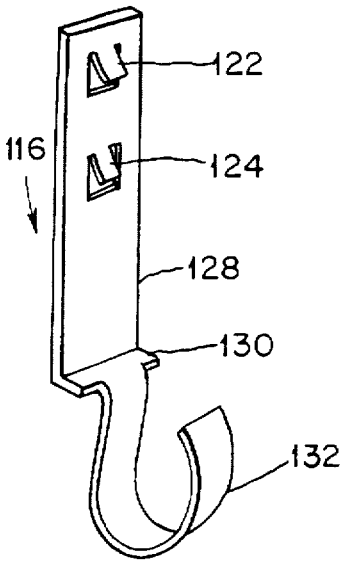
FIG. 22 is a perspective view of an electrically conductive shim used in the first embodiment to make an electrical connection from inside the connection strip to either of a tabbed or a tabless mounting bracket.

Referring to FIGS. 7 and 22, in the first embodiment 10 the back leg 128 of the curled shim 116 extends down from the ground strip 50 to a short leg 130 which bends out above the first notch 94 and continues just beyond the width of the first notch 94 to a curl 132 that extends back down to a vertical plane in which the back leg 128 lies, through the shim recess 84 of the boss 80 beyond a vertical plane formed by the outside surface 72 of the vertical locking member 68. This configuration allows the curled shim 116 to make an electrical connection between the ground strip 50 and tabbed and tabless mounting brackets 30 and 46 when mounted thereon as shown in FIGS. 8 and 9 respectively. The first embodiment 10 preferably includes a shim protector shield 134. Preferably, the shim protector shield includes a first flange member 136 and a second flange member 138 which are attached substantially perpendicularly to the outside surface 72 of the vertical locking member 68 at its first and second edges respectively as shown in FIGS. 15 and 16. Preferably, the flanges 136 and 138 are sloped from the cross member 66 to the boss 80 which allows the cross member 66 to twist when installing and removing the connection strip 10, 1000 from a tabbed mounting bracket 30. The shim protector shield 134 protects wires (not shown) from getting caught on an edge of the curled shim 116. An alternative embodiment of the shim protector shield 134 suitable for use with the first embodiment 10, is shown in FIG. 25 which comprises a tab plate extension member 140 which extends the tab plate member 86 down to the boss 80. This configuration of the shim protector shield 134 allows the cross member 66 to twist freely when installing and removing the connection strip 10, 1000 from a tabbed mounting bracket 30.

The second embodiment 1000 contemplates that the long and short shims 118 and 120 will be available (preferably provided as part of a kit) and that the appropriate shim will be installed in the field by a technician as required by field conditions. The kit would preferably include a block 12 with a first mounting assembly 36, a ground strip 50, a long shim 118, a short shim 120, and a shim retaining wall 126. Preferably, the kit would further include a second mounting assembly 38, and a second long shim 118, a second short shim 120, and a second shim retaining wall 126. If the technician is required to make a grounded connection to a tabbed mounting bracket 30 the long shim 118 can be easily inserted into the block 12 prior to its installation. Similarly, if the technician is required to make a grounded connection to a tabless mounting bracket 46 the short shim 118 can be used.

Figure 23:
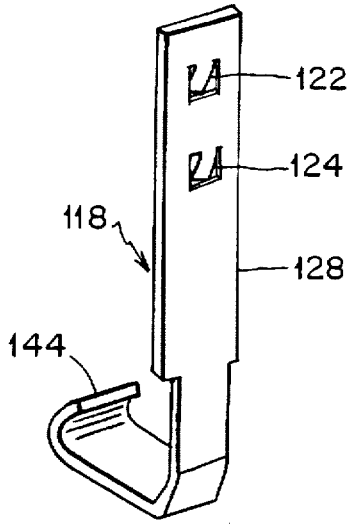
FIG. 23 is a perspective view of an electrically conductive shim used in the second embodiment to make an electrical connection from inside the connection strip to a tabbed mounting bracket.

Referring to FIGS. 11 and 23, when the second embodiment 1000 is fitted with the long shim 118, the back leg 128 extends down from the ground strip 50 to just above the top of the boss 80 where it is bent to run through the shim recess 84 and make contact with a side wall 34 of the tabbed mounting bracket 30 as shown in FIG. 12. The long shim 118 preferably includes a circular-return formation 144 to ensure that the long shim 118 does not get caught in the locking recess during removal.

Figure 24:
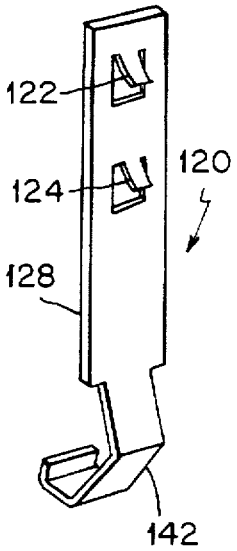
FIG. 24 is a perspective view of an electrically conductive shim used in the second embodiment to make an electrical connection from inside the connection strip to a tabless mounting bracket.

Referring to FIGS. 10 and 24, when the second embodiment 1000 is fitted with the short shim 120, the back leg 128 extends down from the ground strip 50 and wraps around the first and second support tabs 104 and 106 at their respective ends and makes contact with a side wall 34 of the tabless mounting bracket 46 as shown in FIG. 13. The short shim 120 has a bent-out formation 142 to ensure that a good electrical connection is made. In the second embodiment 1000 the support tabs 104 and 106 are formed with a shim-receiving profile 114 to securely seat the short shim 120 as shown in FIG. 10.

Although illustrative embodiments of the present invention have been described herein with reference to the accompanying drawings, it is to be understood that the invention is not limited to those precise embodiments, and that various other changes and modifications may be effected by one skilled in the art without departing from the scope or spirit of the invention.

What is claimed is:

1. An electrical connection strip configured to selectively attach to both a tabbed mounting bracket and a tabless mounting bracket, said electrical connection strip comprising:

an elongated block of electrically non-conductive material, said block having a top, a bottom, a front face, a back face, a first end and a second end; and a first mounting assembly, said first mounting assembly comprising:

a first longitudinal member, said first longitudinal member extending from said first end of said block at said front face of said block adjacent said bottom of said block, said first longitudinal member having a top, a bottom, and an inner face;

a second longitudinal member, said second longitudinal member extending from said first end of said block at said back face of said block adjacent said bottom of said block, said second longitudinal member having a top, a bottom, and an inner face;

a cross member, said cross member extending between said inner face of said first longitudinal member and said inner face of said second longitudinal member, said cross member being elastically rotatable and bendable;

a vertical locking member having an inside surface facing said block, an outside surface facing away from said block, a first edge and a second edge, said vertical locking member extending above and below said first and second longitudinal members and being secured to said cross member;

a locking formation configured to cooperatively engage a locking recess in the tabbed mounting bracket, said locking formation being located on said outside surface of said vertical locking member above said first and second longitudinal members;

a boss configured to cooperatively engage a locking recess in the tabless mounting bracket, said boss being located on said inside surface of said vertical locking member below said first and second longitudinal members; and a rotational fixity member secured to said block.

2. An electrical connection strip as defined in claim 1, wherein said rotational fixity member comprises first and second regions of said first and second longitudinal members respectively, and wherein:

said first and second regions are each formed with a first notch configured to receive an edge of the tabless mounting bracket, said first notch being respectively located on said bottom of said first and second longitudinal members between said first end of said block and said cross member; and said first and second regions are each formed with a second notch configured to receive an edge of the tabbed mounting bracket, said second notch being respectively located on said bottom of said first and second longitudinal members outside of said cross member in a vertical plane adjacent to said outside surface of said vertical locking member.

3. An electrical connection strip as defined in claim 1, wherein said first and second longitudinal members are each formed with a groove configured to receive an edge of the tab of the tabbed mounting bracket, said groove being on said inner face of said longitudinal members outside of said cross member in a vertical plane adjacent to said outside surface of said vertical locking member.

4. An electrical connection strip as defined in claim 1, wherein said first mounting assembly further comprises a tab plate member, said tab plate member extending between said inner face of said first longitudinal member and said inner face of said second longitudinal member and outside of said cross member.

5. An electrical connection strip as defined in claim 4, wherein said tab plate member is configured with a curved central portion to clear an excluding protrusion which is located on the tabbed mounting bracket.

6. An electrical connection strip as defined in claim 1, wherein:

said vertical locking member includes an extension projecting above said locking formation; and said first end of said block is formed with a vertical-locking-member-receiving cavity therein, such that when said extension is pushed toward said first end of said block, said extension is received by said cavity in said block and:

said locking formation disengages from a locking recess in a mounting bracket that includes mounting tabs when mounted thereon; and said boss disengages from a locking recess in a tabless mounting bracket when mounted thereon.

7. An electrical connection strip as defined in claim 1, further comprising:

a ground strip, said ground strip being located within said block;

a curled shim, said curled shim being electrically conductive and configured to extend into said block, to contact said ground strip, and to contact:

the tabbed mounting bracket when mounted thereon; and the tabless mounting bracket when mounted thereon; and a shim retaining wall, said shim retaining wall being located within said block;

wherein said boss is configured with a shim recess to allow said curled shim to pass through a vertical plane formed by said outside surface of said vertical locking member to contact the tabbed mounting bracket when mounted thereon.

8. An electrical connection strip as defined in claim 7, wherein said first mounting assembly includes a shim protection shield.

9. An electrical connection strip as defined in claim 8, wherein said shim protection shield comprises:

a first flange member secured substantially perpendicularly to said outside surface of said vertical locking member at said first edge of said vertical locking member, said first flange member extending from said boss to said cross member; and a second flange member secured substantially perpendicularly to said outside surface of said vertical locking member at said second edge of said vertical locking member, said second flange member extending from said boss to said cross member.

10. An electrical connection strip as defined in claim 8, wherein said shim protection shield comprises a tab plate extension member which extends said tab plate member from below said bottom of said block to said boss.

11. An electrical connection strip configured to selectively attach to both a tabbed mounting bracket and a tabless mounting bracket, said electrical connection strip comprising:

an elongated block of electrically non-conductive material, said block having a top, a bottom, a front face, a back face, a first end and a second end;

a first mounting assembly, said first mounting assembly comprising:

a first longitudinal member, said first longitudinal member extending from said first end of said block at said front face of said block adjacent said bottom of said block, said first longitudinal member having a top, a bottom, and an inner face;

a second longitudinal member, said second longitudinal member extending from said first end of said block at said back face of said block adjacent said bottom of said block, said second longitudinal member having a top, a bottom, and an inner face;

a cross member, said cross member extending between said inner face of said first longitudinal member and said inner face of said second longitudinal member, said cross member being elastically rotatable and bendable;

a vertical locking member having an inside surface facing said block, an outside surface facing away from said block, a first edge and a second edge, said vertical locking member extending above and below said first and second longitudinal members and being secured to said cross member;

a locking formation configured to cooperatively engage a locking recess in the tabbed mounting bracket, said locking formation being located on said outside surface of said vertical locking member above said first and second longitudinal members; and a boss configured to cooperatively engage a locking recess in the tabless mounting bracket, said boss being located on said inside surface of said vertical locking member below said first and second longitudinal members; and a second mounting assembly, said second mounting assembly being attached to said second end of said block and being a substantially identical mirror image of said first mounting assembly.

12. An electrical connection strip as defined in claim 11, further comprising:

a ground strip, said ground strip being located within said block;

a pair of curled shims, said curled shims being electrically conductive and configured to extend into said block to contact said ground strip, and to contact:

the tabbed mounting bracket when mounted thereon; and the tabless mounting bracket when mounted thereon; and a pair of shim retaining walls, said shim retaining walls being located within said block; wherein said bosses are configured with a shim recess to allow said curled shims to pass through a vertical plane formed by said outside surface of said vertical locking member to contact the tabbed mounting bracket when mounted thereon.

13. An electrical connection strip as defined in claim 12, wherein said first and second mounting assemblies include a shim protection shield.

14. An electrical connection strip as defined in claim 13, wherein said shim protection shield comprises:

a first flange member secured substantially perpendicularly to said outside surface of said vertical locking member at said first edge of said vertical locking member, said first flange member extending from said boss to said cross member; and a second flange member secured substantially perpendicularly to said outside surface of said vertical locking member at said second edge of said vertical locking member, said second flange member extending from said boss to said cross member.

15. An electrical connection strip as defined in claim 13, wherein said shim protection shield comprises a tab plate extension member which extends said tab plate member from below said bottom of said block to said boss.

16. An electrical connection strip as defined in claim 11, wherein said first and second longitudinal members are each formed with a groove configured to receive an edge of the tab of the tabbed mounting bracket, said groove being on said inner face of said longitudinal members outside of said cross member in a vertical plane adjacent to said outside surface of said vertical locking member.

17. An electrical connection strip as defined in claim 11, wherein said first and second mounting assemblies further comprise a tab plate member, said tab plate member extending between said inner face of said first longitudinal member and said inner face of said second longitudinal member and outside of said cross member.

18. An electrical connection strip as defined in claim 17, wherein said tab plate member is configured with a curved central portion to clear an excluding protrusion which is located on the tabbed mounting bracket.

19. An electrical connection strip as defined in claim 11, wherein:

said vertical locking member includes an extension projecting above said locking formation; and said first and second ends of said block are each formed with a vertical-locking-member-receiving cavity therein, such that when said extension is pushed toward said ends of said block, said extension is received by said cavity in said block and:

said locking formation disengages from a locking recess in a mounting bracket that includes mounting tabs when mounted thereon; and said boss disengages from a locking recess in a tabless mounting bracket when mounted thereon.

20. An electrical connection strip kit of component parts for assembling an electrical connection strip configured to selectively attach to both a tabbed mounting bracket and a tabless mounting bracket, said kit comprising:

an elongated block of electrically non-conductive material, said block having a top, a bottom, a front face, a back face, a first end and a second end; and a first mounting assembly, said first mounting assembly comprising:

a first longitudinal member, said first longitudinal member extending from said first end of said block at said front face of said block adjacent said bottom of said block, said first longitudinal member having a top, a bottom, and an inner face;

a second longitudinal member, said second longitudinal member extending from said first end of said block at said back face of said block adjacent said bottom of said block, said second longitudinal member having a top, a bottom, and an inner face;

a cross member, said cross member extending between said inner face of said first longitudinal member and said inner face of said second longitudinal member, said cross member being elastically rotatable and bendable;

a vertical locking member having an inside surface facing said block, an outside surface facing away from said block, a first edge and a second edge, said vertical locking member extending above and below said first and second longitudinal members and being secured to said cross member;

a locking formation configured to cooperatively engage a locking recess in the tabbed mounting bracket, said locking formation being located on said outside surface of said vertical locking member above said first and second longitudinal members;

a boss configured to cooperatively engage a locking recess in the tabless mounting bracket, said boss being located on said inside surface of said vertical locking member below said first and second longitudinal members; and a rotational fixity member secured to said block, a first support tab secured to said bottom of said block at said first end of said block;

a ground strip, said ground strip being located within said block;

a long shim, said long shim being electrically conductive and configured to extend into said block and contact said ground strip and to contact the tabbed mounting bracket when mounted thereon;

a short shim, said short shim being electrically conductive and configured to extend into said block and contact said ground strip and to contact the tabless mounting bracket when mounted thereon; and a shim retaining wall, said shim retaining wall being located within said block;

wherein said boss is configured with a shim recess to allow said second electrically conductive shim to pass through a vertical plane formed by said outside surface of said vertical locking member to contact the tabbed mounting bracket when mounted thereon.

21. An electrical connection strip kit as defined in claim 20, wherein said rotational fixity member comprises first and second regions of said first and second longitudinal members respectively, and wherein:

said first and second regions are each formed with a first notch configured to receive an edge of the tabless mounting bracket, said first notch being respectively located on said bottom of said first and second longitudinal members between said first end of said block and said cross member; and said first and second regions are each formed with a second notch configured to receive an edge of the tabbed mounting bracket, said second notch being respectively located on said bottom of said first and second longitudinal members outside of said cross member in a vertical plane adjacent to said outside surface of said vertical locking member.

22. An electrical connection strip kit as defined in claim 21, wherein said first support tab is formed with a shim-receiving profile to receive a short shim to contact a tabless mounting bracket when mounted thereon.

23. An electrical connection strip kit of component parts for assembling an electrical connection strip configured to selectively attach to both a tabbed mounting bracket and a tabless mounting bracket, said kit comprising:

an elongated block of electrically non-conductive material, said block having a top, a bottom, a front face, a back face, a first end and a second end; and a first mounting assembly, said first mounting assembly comprising:

a first longitudinal member, said first longitudinal member extending from said first end of said block at said front face of said block adjacent said bottom of said block, said first longitudinal member having a top, a bottom, and an inner face, a second longitudinal member, said second longitudinal member extending from said first end of said block at said back face of said block adjacent said bottom of said block, said second longitudinal member having top, a bottom, and an inner face;

a cross member, said cross member extending between said inner face of said first longitudinal member and said inner face of said second longitudinal member, said cross member being elastically rotatable and bendable;

a vertical locking member having an inside surface facing said block, an outside surface facing away from said block, a first edge and a second edge, said vertical locking member extending above and below said first and second longitudinal members and being secured to said cross member;

a locking formation configured to cooperatively engage a locking recess in the tabbed mounting bracket, said locking formation being located on said outside surface of said vertical locking member above said first and second longitudinal members; and a boss configured to cooperatively engage a locking recess in the tabless mounting bracket, said boss being located on said inside surface of said vertical locking member below said first and second longitudinal members;

a second mounting assembly, said second mounting assembly being attached to said second end of said block and being a substantially identical mirror image of said first mounting assembly;

a first support tab secured to said bottom of said block at said first end of said block;

a second support tab secured to said bottom of said block at said second end of said block;

a ground strip, said ground strip being located within said block;

a pair of long shims, wherein said long shims being electrically conductive and configured to extend into said block and contact said ground strip and to contact the tabbed mounting bracket when mounted thereon;

a pair of short shims, wherein said short shims being electrically conductive and configured to extend into said block and contact said ground strip and to contact the tabless mounting bracket when mounted thereon;

a pair of shim retaining walls, said shim retaining walls being located within said block; wherein said bosses are configured with a shim recess to allow said long shims to pass through a vertical plane formed by said outside surface of said vertical locking member to contact the tabbed mounting bracket when mounted thereon.

24. An electrical connection strip kit as defined in claim 23, wherein said first and second support tabs are each formed with a shim-receiving profile to receive a short shim to contact a tabless mounting bracket when mounted thereon.

* * * * *